United States Patent [19]

Matsui et al.

[11] 4,390,932

[45] Jun. 28, 1983

[54] HANGER ARM MECHANISM IN DENTAL LIGHTING EQUIPMENT

[75] Inventors: Takahiro Matsui, Uji; Minoru Watanabe, Shinnaka, all of Japan

[73] Assignee: Kabushiki Kaisha Morita Seisakusho, Kyoto, Japan

[21] Appl. No.: 302,976

[22] Filed: Sep. 17, 1981

[30] Foreign Application Priority Data

Jul. 3, 1981 [JP] Japan ..... 56-99744[U]

[51] Int. Cl.[3] ..... F21V 21/26

[52] U.S. Cl. ..... 362/269; 362/33; 362/287; 362/389; 362/419; 362/422; 362/427; 362/804

[58] Field of Search ..... 362/33, 269, 287, 389, 362/419, 422, 427, 804

[56] References Cited

U.S. PATENT DOCUMENTS

| | | | |
|---|---|---|---|
| 3,897,141 | 7/1975 | Schocket | 362/419 |
| 4,280,172 | 7/1981 | Krogsrud | 362/427 |
| 4,333,132 | 6/1982 | Paley | 362/421 |

*Primary Examiner*—Stephen J. Lechert, Jr.
*Attorney, Agent, or Firm*—Koda and Androlia

[57] ABSTRACT

A hanger arm mechanism to hold a lamp head vertically rotatably in dental lighting equipment is directed to a mechanism designed to rotate the lamp head around the axis shaftline of the hanger arm and to stop the same in a desired position, with the result that the field of lighting of the shadowless lamp mounted inside the lamp head can freely be changed in the range of rotation of the lamp head without making the patient turn his head.

3 Claims, 5 Drawing Figures

HANGER ARM MECHANISM IN DENTAL LIGHTING EQUIPMENT

BACKGROUND OF THE INVENTION

1. Field of the Invention

This invention generally relates to improvements in dental lighting equipment and more particularly to a hanger arm mechanism in the dental lighting equipment designed to enable a lamp head to move around the axis shaftline of the hanger arm.

2. Prior Art

Lighting equipment for use in dental treatment makes it necessary from a functional view point, for the principal axis of the field of lighting to be positioned at right angles with the body axis of a patient by making the field of lighting rectangular in shape; and besides, because a shadowless lamp is used in recent lighting equipment, it is necessary to keep the distance between the lamp head and the oral cavity of the patient substantially definite.

In the prior art, there exists a lighting equipment which is constructed of a horizontally movable arm, a vertically movable arm and a hanger arm. In such equipment, the lamp head is attached to the hanger arm so as to be merely vertically movable; accordingly, operation of an arm mechanism can perform merely dual movement, namely, horizontal and vertical movement to the lamp with respect to a patient so that even if the field of lighting is correnctly positioned with respect to the oral cavity of the patient, when light is cast on the left side or right side interiorly of the mouth of the patient sitting properly with respect to the field of lighting, it is impossible to obtain a satisfactory amount of light unless an object is shifted onto the principal axis of the field of lighting by moving the head of the patient either to the left or to the right side. This inconvenience in handling posed the problem that both the patient and the operator get fatigued by such cumbersome handling.

SUMMARY OF THE INVENTION

Accordingly, the general object of this invention is to solve the problems of the kind described above.

The structural feature of the invention is such that a rotary member having a lamp head is rotatably mounted with a certain range around the axis shaftline of a hanger arm to obtain such friction force as can stop the rotary member in a desired rotation position between the rotary member and the hanger arm. A detailed description will now be given of an embodiment of the invention with reference to the accompanying drawings.

DETAILED DESCRIPTION OF THE INVENTION

Figure 1:
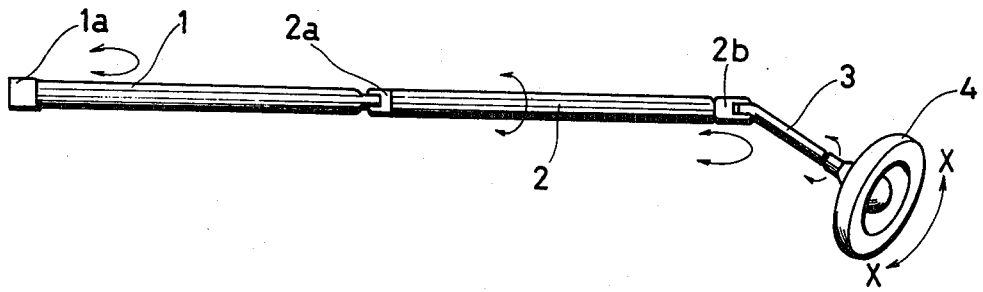
FIG. 1 is a side elevation of an embodiment of the invention.

A preferred embodiment of the invention is shown in FIGS. 1 through 5. In the embodiment, the outer circumference of a rotary member is spaced away inwardly of a hanger arm body so as to permit free rotation of the member; and the rotating slide contact portion is constituted of a flange portion formed concentrically with the rotary member and of a flange member formed on a fixed member disposed inside the hanger arm body separately from the rotary member, and further a friction adjusting member is employed for giving mutually opposing pressure contact resilience along the axis shaftline of the hanger arm both to the flange portion and to the flange member. According to a hanger arm mechanism in the embodiment used in a dental lighting equipment, it includes a horizontally movable arm 1, vertically movable arm 2, hanger arm 3 and lamp head 4. The hanger arm 3 comprises a hanger arm body 30 made of a pipe member, a rotary member 31 having a lamp head 4 vertically movably in the front part thereof and inserted in the hanger arm body 30 so as to be rotatable around the axis shaftline thereof, a rotating slide contact portion 32 formed in the rotary member 31 for giving rotation to the rotary member 31 under pressure contact friction, and a friction adjusting member 33 for varying friction force of the rotating slide contact portion 32. The rotary member 31 comprises a hollow cylinder having a lamp head fitting member 34 in the front part and a flange 310 in the rear part thereof, respectively. A cylindrical fixed member 5 is provided in the hanger arm body 30 behind the rotary member 31. A ringlike flange member 51 is attached to the tip portion of the fixed member 5 and is brought into slidable contact with the flange 310 to constitute the rotating slide contact portion 32; and a compression spring 6 is disposed on the outer circumference of the rotary member 31 to produce axially resilient force for drawing out the flange 310 of the hanger arm body 30 and for pushing in the ringlike flange member 51 in the direction opposite thereto so as to constitute thereby a friction adjusting member 33 for varying the frictional force of the rotating slide contact portion 32. In the embodiment described, the lamp head fitting member 34 is threadedly connected to the front part of the rotary member 31 and the ringlike flange member 51 is threadedly connected to the front part of the fixed member 5.

The fixed member 5 can be horizontally rotated by a vertical shaft 18 of a bearing portion 8, and is enabled by use of an adjusting screw 9 to control the frictional force which is applied in time of being horizontally rotated around the vertical shaft 18. In order to regulate the range of operation of the rotary member 31, a stopper disc 10 circumferentially having a stopper pawl 52 is fixed by a screw 11 to the fixed member 5 so that the rear end portion 39 of the rotary member 31 is brought into abutment against the stopper pawl 52 and stopped by the progressively increasing rotation of the rear end portion 39 of the rotary member 31.

Figure 2:
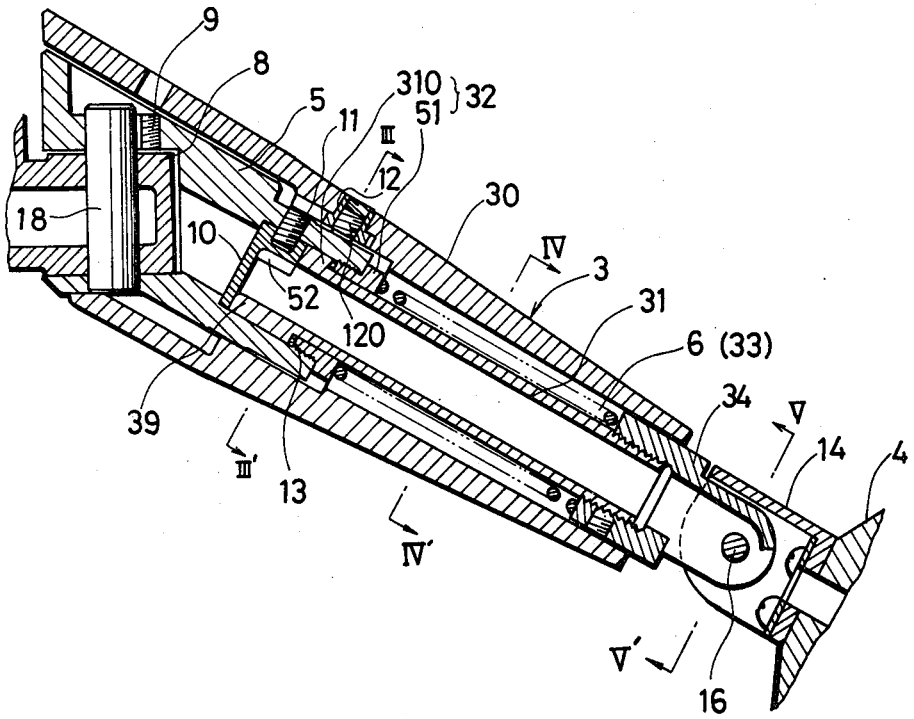
FIG. 2 is a longitudinal sectional side elevation of the essential part of the invention.
Figure 3:
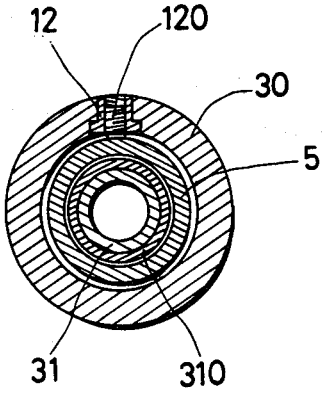
FIG. 3 is a sectional view taken along the line III—III' of FIG. 2.
Figure 4:
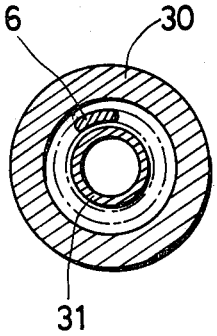
FIG. 4 is a sectional view taken along the line IV—IV' of FIG. 2.
Figure 5:
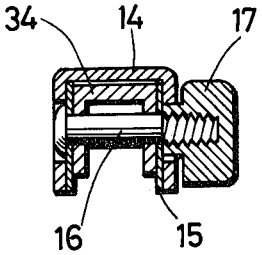
FIG. 5 is a sectional view taken along the line V—V' of FIG. 2.

In order to prevent relative movement between the hanger arm body 30 and the fixed member 5, a screw bush 12 is formed in the corresponding portion of the body 30 and a set screw 120 is screwed into the bush 12 and abuts against the fixed member 5. A friction washer 13 is interposed between the slide contact surfaces of the flange member 51 and flange 310. The lamp head fitting member 34, as shown in FIGS. 2 and 5, is formed at the front end in an inverted U-shape and is laid through a slide plate 15 over the inside of an inverted U-shaped fitting 14 connected to the lamp head 4. A support pin 16 pieces through the lamp head fitting member 34, plate 15 and the fitting 14, and the pin 16 is threadedly mounted with a tightening nut 17 so as to permit the vertical movement of the lamp head 4 around the pin 16. Since the structure of the rotating portion 1*a* of the horizontally movable arm 1 and of the rotating portion 2*a* of the vertically movable arm 2 are well known, the detailed description thereof is omitted.

In the embodiment constructed as described, the forward resilient force of the compression spring 6 acts as force for drawing out the rotary member 31 forwardly in the direction of the axis shaftline of the member 31 through the lamp head fitting member 34, while the rearward resilient force of the spring 6 acts as force for pushing in the flange member 51 rearwardly in the direction of the axis shaftline of the member 31, with the result that mutually opposing pressure contact resilient force is given to the rotating slide contact surfaces (friction washer 13 in the embodiment shown) of the flange 310 and of the flange member 51. Accordingly, the supply of this resilient force in a suitable form makes it possible to rotate the rotary member 31 together with the lamp head 4 around the axis shaftline of the hanger arm 3 and to stop the rotation thereof in a desired position and to effect the rotation of the rotary member 31 again by rotating the lamp head 4 against the action of the resilient force. (Refer to arrows x—x in FIG. 1).

As apparent from the description given so far, since the invention enables the lamp head to rotate and stop freely around the axis shaftline of the hanger arm through the rotating member in addition to such vertical and horizontal rotations as were the case with conventional devices, the invention renders it possible to change the direction of rectangular field of lighting of the lamp head as occasion demands whereby the direction of field of lighting is fixed and a patient enabled to obtain a desired direction of lighting without turning his head as opposed to the conventional devices. Thus, the invention provides the advantage of facilitating treatment operation and relieving both the patient and the operator of their fatigue during the operation.

The description above has been given of one preferred embodiment of the invention, but it should be understood that the invention is not limited to the embodiment illustrated but various other replacements, modifications and additions may structurally be possible without departing from the scope and spirit of the invention.

We claim:

1. A hanger arm mechanism in dental lighting equipment including a horizontally movable arm, a vertically movable arm, a hanger arm and a lamp head, said mechanism being characterized in that said hanger arm comprises:

a hanger arm body made of a pipe member;

a rotary member, said rotary member being provided in the front portion of said hanger arm body and vertically movable with the lamp head and being inserted into and coupled to said hanger arm body so as to be freely rotatable about the axis shaft line of the hanger arm body; and a friction adjusting member, said member being adapted to change the rotating slide contact portion formed in said rotary member and the friction force of said contact portion for affecting rotation of said rotary member under pressure contact friction.

2. A mechanism according to claim 1, wherein said rotary member comprises:

a hollow cylinder, said cylinder being provided in the front part with a lamp head fitting and in the rear part with a flange;

said hanger arm body behind said rotary member is provided with a cylindrical fixed member, said fixed member being fitted in the front part with a ringlike flange member to thereby come into slidable contact with said flange to constitute a rotating slide contact portion;

said rotary member being enveloped over the outer circumference thereof with a compression spring to thereby produce resilient force for drawing out said flange in the direction of the axis shaftline of said hanger arm and for pushing in said ringlike flange member in the direction opposite thereto so as to constitute a friction adjusting member adapted to change the frictional force of said rotating slide contact portion.

3. A mechanism according to claim 2, wherein said lamp head fitting member is threadedly connected to the front part of said rotary member, and said ringlike flange member is threadedly connected to the front part of said fixed member.

* * * * *